US012685391B2

(12) United States Patent
Clement et al.

(10) Patent No.: US 12,685,391 B2
(45) Date of Patent: Jul. 21, 2026

(54) DEVICE FOR STORING PLATES FORMING A DINNER TRAY FOR A POOL TABLE

(71) Applicant: CORNILLEAU SAS, Bonneuil les Eaux (FR)

(72) Inventors: Fabrice Clement, Paillart (FR); Sean Parat O'connor, Therdonne (FR); Nicolas Havard, Bonneuil les Eaux (FR)

(73) Assignee: CORNILLEAU SAS, Bonneuil les Eaux (FR)

( * ) Notice: Subject to any disclaimer, the term of this patent is extended or adjusted under 35 U.S.C. 154(b) by 67 days.

(21) Appl. No.: 18/827,294

(22) Filed: Sep. 6, 2024

(65) Prior Publication Data

US 2025/0072602 A1 Mar. 6, 2025

(30) Foreign Application Priority Data

Sep. 6, 2023 (FR) ..... 2309376

(51) Int. Cl.

| | |
|---|---|
| ***A47B 85/06*** | (2006.01) |
| ***A47B 13/08*** | (2006.01) |
| ***A47B 37/00*** | (2006.01) |
| ***A63D 15/04*** | (2006.01) |

(52) U.S. Cl.

CPC ..... *A47B 85/06* (2013.01); *A47B 13/088* (2013.01); *A47B 37/00* (2013.01); *A63D 15/04* (2013.01)

(58) Field of Classification Search

CPC ..... A47B 85/06; A47B 13/088; A47B 37/00; A47B 25/00; A63D 15/04

USPC ..... 248/201, 241–243; 108/90, 13, 14, 16, 108/110, 107, 109, 149; 312/277; 211/27, 49.1, 85.29, 85.31, 113, 117, 208, 211/181.1; 473/10

See application file for complete search history.

(56) References Cited

U.S. PATENT DOCUMENTS

| | | | | |
|---|---|---|---|---|
| 2,115,115 A | | 4/1938 | Matteson et al. | |
| 2,168,172 A | * | 8/1939 | Rees | F24C 15/16 126/339 |
| 2,284,339 A | * | 5/1942 | Nauert | F25D 25/02 312/266 |
| 2,532,236 A | * | 11/1950 | Klazkin | A47D 9/02 5/103 |

(Continued)

FOREIGN PATENT DOCUMENTS

| | | | | |
|---|---|---|---|---|
| CA | 2626653 A1 | | 9/2009 | |
| CN | 106993887 A | * | 8/2017 | A63F 3/02 |

(Continued)

*Primary Examiner* — Janet M Wilkens

(74) *Attorney, Agent, or Firm* — MUNCY, GEISSLER, OLDS & LOWE, P.C.

(57) ABSTRACT

A storage device for storing plates forming a dinner tray for a pool table includes a support frame arranged to carry the dinner tray plates, and stops for fixing the support frame to a chassis of the pool table. The stops are arranged to enable a vertical movement of the support frame between a returned position, in which the support frame is intended to extend horizontally to the proximity of the chassis, and a deployed position, in which the support frame is intended to extend horizontally at a distance from the chassis. The stops support the support frame in the deployed position and retain the support frame in the returned position.

6 Claims, 5 Drawing Sheets

(56) References Cited

U.S. PATENT DOCUMENTS

| | | | | | |
|---|---|---|---|---|---|
| 2,829,813 | A * | 4/1958 | Sebell | B43L 3/008 | 224/311 |
| 2,947,585 | A * | 8/1960 | Fazio | B60N 3/002 | 108/136 |
| 3,048,459 | A * | 8/1962 | Moore | A63D 15/04 | 108/90 |
| 3,332,655 | A * | 7/1967 | Buren, Jr. | A47B 57/58 | 312/351 |
| 3,848,277 | A * | 11/1974 | Reguitti | A47D 9/012 | 5/93.1 |
| 5,483,902 | A * | 1/1996 | Grosch | A47B 21/02 | 108/143 |
| 5,836,562 | A * | 11/1998 | Danzyger | A47B 21/0314 | 248/231.71 |
| 6,766,747 | B1 * | 7/2004 | Wolfe | A47B 25/00 | 108/26 |
| 8,661,739 | B2 * | 3/2014 | Keenan | E04B 1/003 | 52/27 |
| 2005/0255928 | A1 * | 11/2005 | Nally | A63D 15/04 | 473/10 |
| 2011/0262217 | A1 | 10/2011 | Tsai | | |
| 2021/0346786 | A1 | 11/2021 | Schneider et al. | | |

FOREIGN PATENT DOCUMENTS

| | | | | |
|---|---|---|---|---|
| DE | 19606924 | A1 * | 8/1997 | A47B 25/00 |
| GB | 190923487 | A | 8/1910 | |
| GB | 2030874 | A * | 4/1980 | A63D 15/04 |
| WO | WO2009131552 | A1 | 10/2009 | |

* cited by examiner

DEVICE FOR STORING PLATES FORMING A DINNER TRAY FOR A POOL TABLE

The present invention relates to equipment for playing pool, and more specifically, a device for storing a dinner tray for a pool table. The invention also relates to a pool table equipped with such a device.

BACKGROUND OF THE INVENTION

Pool is a game of skill which is played with one or more players on a table bordered with strips and covered with a fabric. The game consists of making balls roll over the table by hitting them using a cue.

Pool tables are heavy and bulky units, and generally do not have any other use than that of playing pool. To overcome this disadvantage, it is known to cover the pool table with a tray in order to transform it into a dining table being able to comfortably accommodate ten people.

If such a transformation makes it possible to make the most of the inside space of a dwelling, it has proved to be that the tray must be removed and stored elsewhere when it is not used. Yet, the tray has proved to be particularly bulky and its movement demands a significant effort, and this all the more so when its storage space is away from the table.

AIM OF THE INVENTION

The invention aims to propose a device for storing a dinner tray for a pool table making it possible to overcome at least some of the abovementioned disadvantages.

SUMMARY OF THE INVENTION

To this end, a device for storing plates forming a dinner tray for a pool table is provided, according to the invention. The storage device comprises a support frame arranged to carry the dinner tray plates, and stops for fixing the support frame to a chassis of the pool table. The stops are arranged to enable a vertical movement of the support frame between a returned position, in which the support frame is intended to extend horizontally to the proximity of the chassis, and a deployed position, in which the support frame is intended to extend horizontally at a distance from the chassis, the stops being provided with means for supporting the support frame in the deployed position and, above the support means, means (22.5) for retaining the support frame in the returned position.

Such a storage device thus makes it possible to store the plates forming the dinner tray under the pool table, the support frame being able to be dissimulated when it is not used to receive said plates.

According to a particular feature, the support frame comprises a wired framework comprising two first wires connected to one another by second wires, the first wires comprising end sections forming tenons intended to be received in a groove provided in the stops.

Particularly, the end sections of the first wires extend along one same direction.

Particularly, the end sections of each of the first wires extend along one same axis.

According to a particular feature, each of the stops comprises a body comprising side walls delimiting the groove, the side walls each comprising a window inside which a tab extends, which is formed integrally with the side wall and which is provided with a raised element rotated towards the inside of the groove to form the retaining means, the tabs being elastically deformable between a rest state in which the raised elements define a passage cross-section less than a diameter of the end sections of the first wires of the support frame, and a deformed state in which the raised elements define a passage cross-section equal to or slightly greater than the diameter of said end sections.

Particularly, the raised elements of the tabs are rounded.

The invention also relates to a pool table comprising a chassis, under which a storage device is fixed, according to any one of the preceding claims via the stops.

BRIEF DESCRIPTION OF THE DRAWINGS

The invention will be best understood in the light of the description below, which is purely illustrative and non-limiting, and must be read regarding the accompanying drawings, among which.

DETAILED DESCRIPTION OF THE INVENTION

Figure 1:
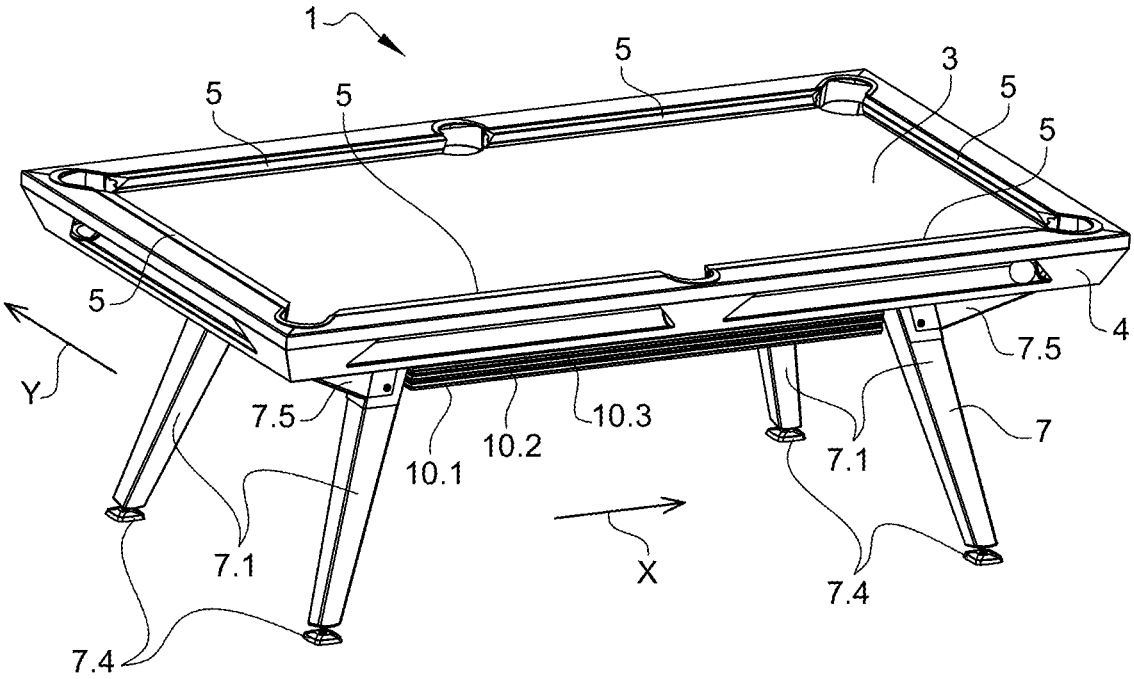
FIG. 1 is a perspective view of a pool table equipped with a storage device according to a particular embodiment of the invention, in which the support frame of the storage device is in the deployed position and carries three plates forming a dinner tray.
Figure 2:
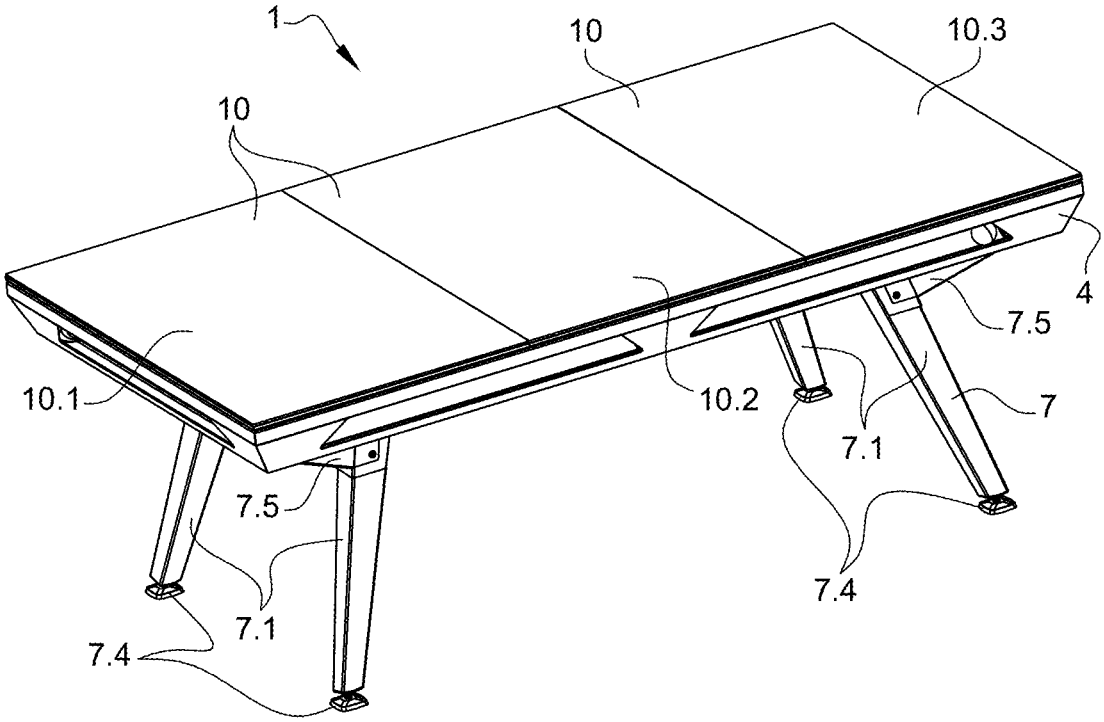
FIG. 2 is a view similar to FIG. 1, in which the table is covered with the dinner tray, the support frame of the storage device being in the returned position.
Figure 3:
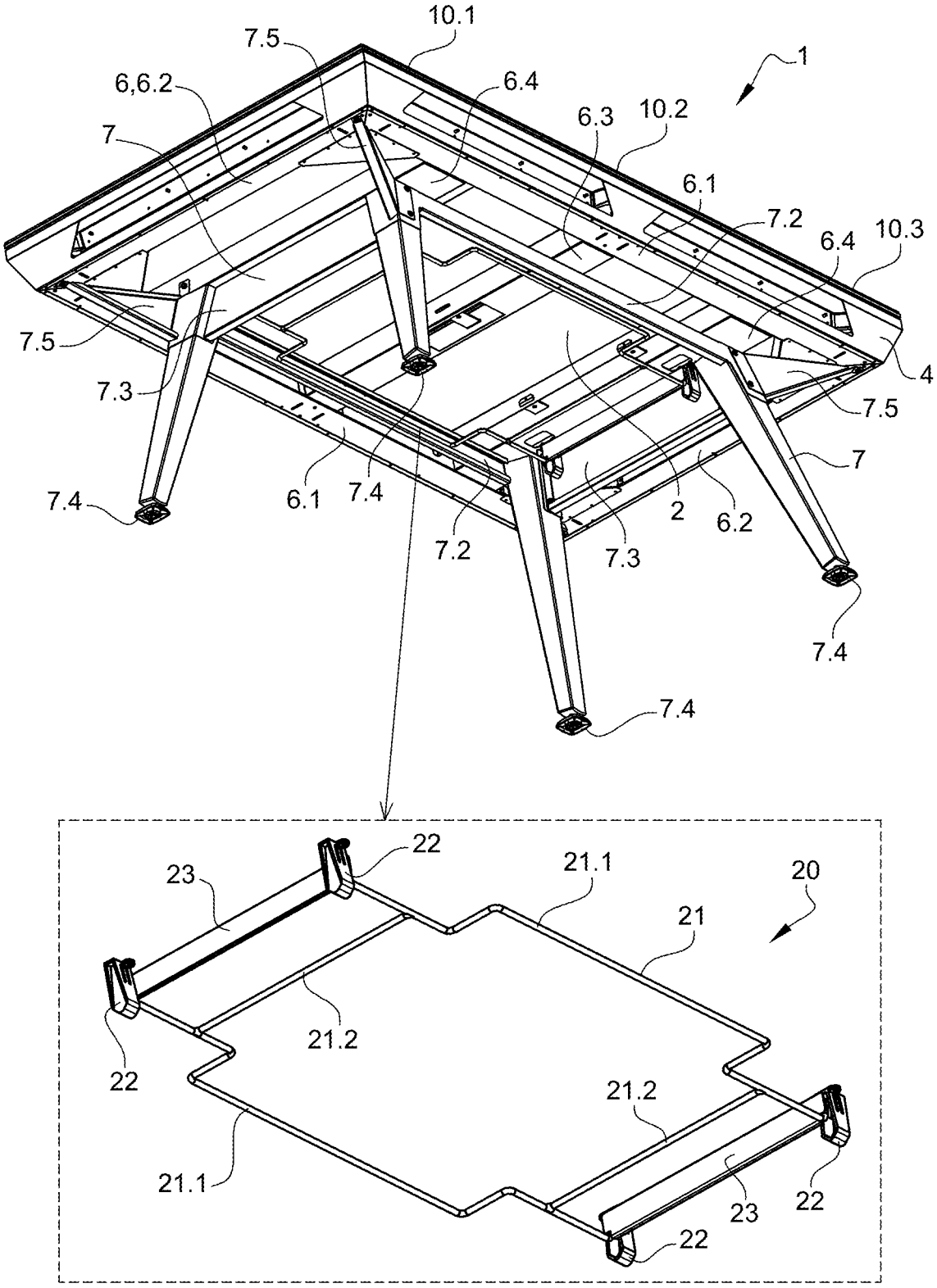
FIG. 3 is another perspective view of the pool table illustrated in FIG. 2, in which the storage device can be seen.

In reference to FIGS. 1 to 3, the invention is described in application to a pool table 1 equipped with a dinner tray 10 and a device 20 for storing the dinner tray 10.

The pool table 1 comprises, in a manner known per se:

- a rectangular plate 2, in this case made of slate, extending into a horizontal plane and comprising an upper face covered with a cloth 3 defining a rolling surface for balls;
- a game frame 4 surrounding the plate 2 to delimit with the cloth 3, a movement area for the balls, and on which return strips 5 are fixed, in this case, natural rubber-based;
- a chassis 6, rectangular-shaped, on which the plate 2 rests and the game frame 4 is fixed; and
- a base 7 on which the chassis 6 is fixed.

The chassis 6 comprises two side members 6.1 having ends connected to one another by two main cross-members 6.2 to form a support frame of the slate plate 2. The side members 6.1 and the main cross-members 6.2 have substantially identical cross-sections, and extend respectively along a longitudinal direction X and a transverse direction Y of the pool table, the transverse direction Y being orthogonal to the longitudinal direction X.

To avoid any deformation of the plate 2 under its own weight, the chassis 6 also comprises three secondary cross-members, called reinforcing cross-members, connecting the side members 6.1 to one another so as to ensure, in the same way as said side members 6.1 and the main cross-members 6.2, the supporting of the plate 2. The secondary cross-members extend between the main cross-members 6.2, parallel to these, and comprise a central cross-member 6.3 and two intermediate cross-members 6.4 extending symmetrically on either side of the central cross-member 6.3.

The base 7 comprises four feet 7.1 having upper ends connected to one another by two longitudinal cross-members 7.2 and two transverse cross-members 7.3, and lower ends provided with height-adjustable runners 7.4 to be able to adjust the horizontality of the rolling surface when the table 1 rests on the ground. The secondary cross-members 6.3, 6.4 of the chassis 6 rest on the longitudinal cross-members 7.2 and the transverse cross-members 7.3 of the base 7, and the frame of the chassis 6 (formed by the side members 6.1 and the main cross-members 6.2) is fixed to the feet 7.1 through four struts 7.5.

The dinner tray 10 is, in this case, formed by three identical plates 10.1, 10.2, 10.3, each of the plates 10.1, 10.2, 10.3 having a length substantially equal to a width of the game frame 4, and a width substantially equal to one third of a length of the game frame 4. The plates 10.1, 10.2, 10.3 each thus have a covering surface substantially equal to one third of the surface delimited by outer edges of the game frame 4, so as to be able to totally cover said game frame 4.

To transform the pool table 1 into a dining table, the plates 10.1, 10.2, 10.3 forming the dinner tray are disposed on an upper face of the game frame 4, in the extension, either following the longitudinal direction X of the table 1, so as to totally cover said game frame 4 and form a flat surface (FIG. 2).

When the pool table 1 is used to play pool, the plates 10.1, 10.2, 10.3 forming the dinner tray are, as will be seen below, stored in the storage device 20 arranged under the pool table 1, said plates 10.1, 10.2, 10.3 being stacked on one another (FIG. 1).

The storage device 20 comprises a support frame 21 movable mounted between a so-called "return" high position and a so-called "deployed" low position on the chassis 6 via four fixing stops 22, the support frame 21 extending substantially horizontally in the return and deployed positions, respectively in the proximity and at a distance from the chassis 6.

The support frame 21 is symmetrical and comprises a wired framework, in this case made of steel, on which two side guiding plates 23 are fixed.

The framework comprises two first wires 21.1 extending mainly along the longitudinal direction X of the table, and two second wires 21.2 extending mainly perpendicularly to the first wires 21.1 along the transverse direction Y. The second wires 21.2 have ends welded to the first wires 21.1, such that said first wires 21.1 are connected to one another by said second wires 21.2. The first and second wires 21.1, 21.2 have a constant diameter, substantially equal to 10 millimetres.

Figure 4:
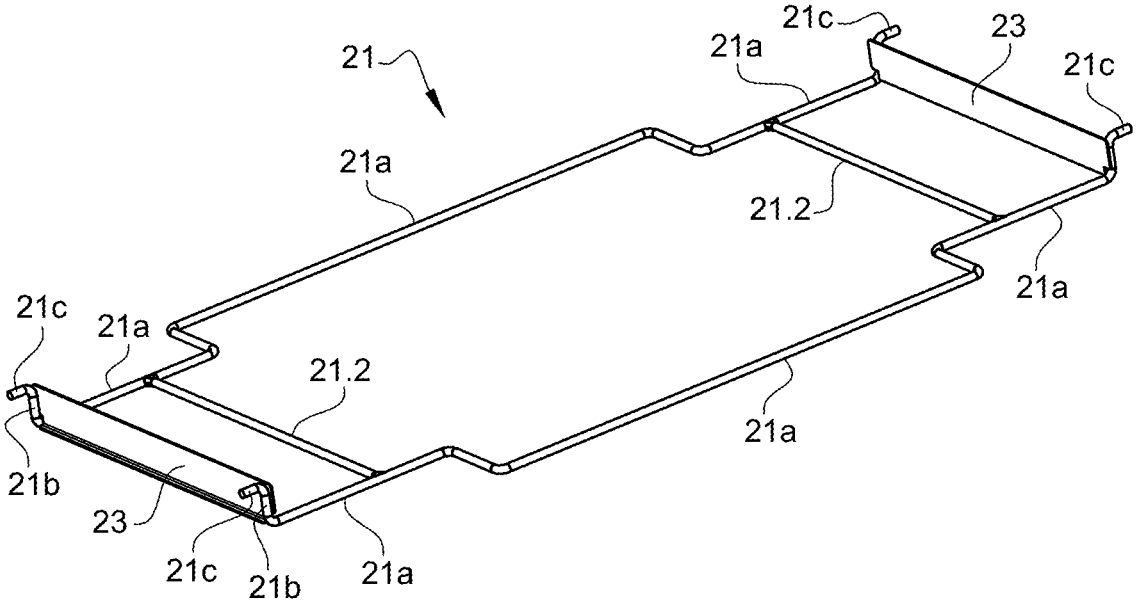
FIG. 4 represents a perspective view of the support frame of the storage device illustrated in FIG. 3.

In reference to FIG. 4, each of the first wires 21.1 comprises:

a main section 21*a;* two intermediate sections 21*b* which extend on either side of the main section 21*a* and which are connected to said main section 21*a* by first bends obtained by first 90-degree foldings of the first wire 21.1; and two end sections 21*c* which extend along one same axis into the extension of the intermediate sections 21*b* and which are connected to said intermediate sections 21*b* by second bends obtained by second 90-degree foldings of the first wire 21.1, to form tenons extending to the outside of the support frame 21.

The main section 21*a* and the end sections 21*c* extend along the longitudinal direction X of the table 1, and the intermediate sections 21*b* extend along a direction orthogonal to the second wires 21.2. The guiding plates 23 have ends welded over the intermediate sections 21*b* of the first wires 21.1 and extend parallel to the second wires 21.2 so as to be spaced apart from a distance slightly greater than the length of the plates 10.1, 10.2, 10.3.

Figure 5:
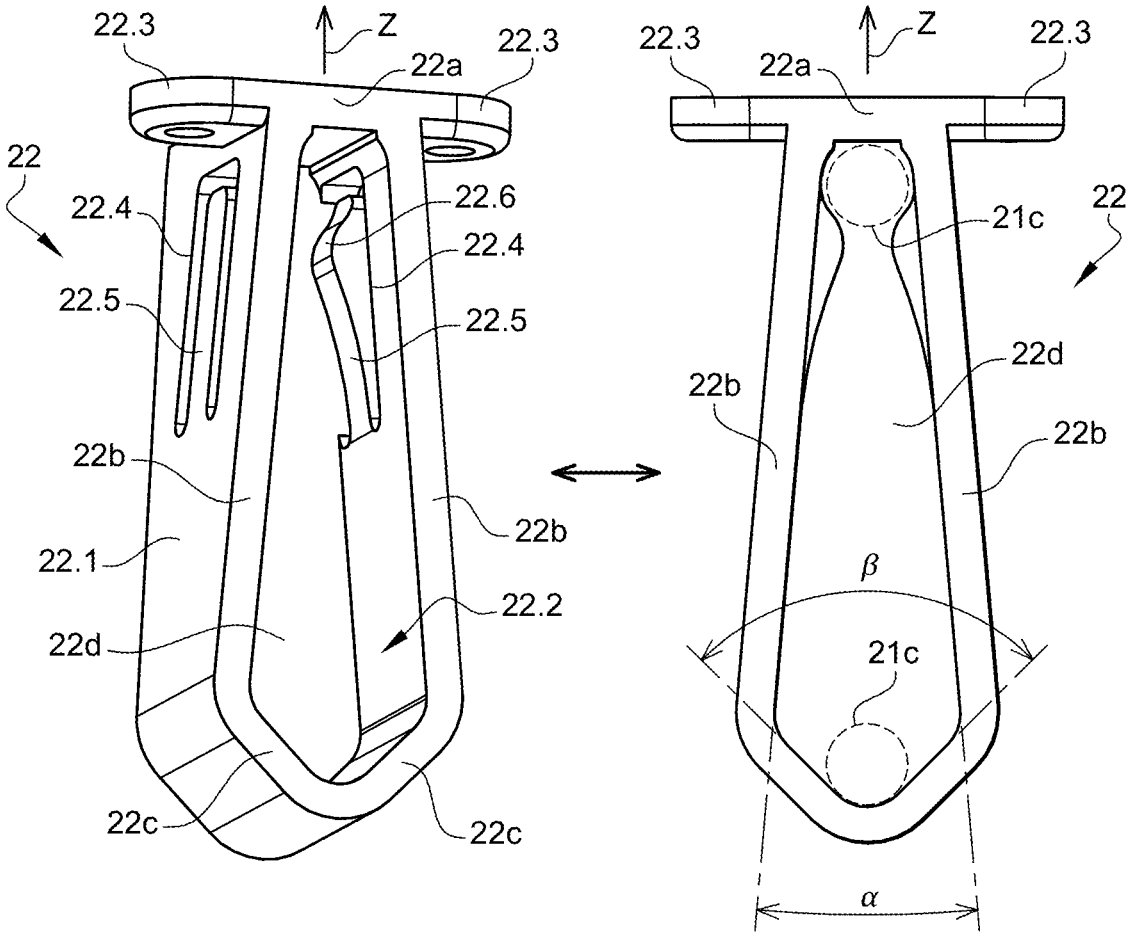
FIG. 5 represents a perspective view and a front view of one of the fixing stops of the support frame illustrated in FIG. 4.

In reference to FIG. 5, the stops 22 are identical and comprise a one-piece body 22.1 which is extended along a vertical direction Z orthogonal to the longitudinal and transverse directions X, Y of the table 1. The body 22.1 is symmetrical and comprises a vertical groove 22.2 in which one of the end sections 21*c* of the support frame 21 is received. The groove 22.2 delimits:

an upper wall 22*a* of the body 22.1 from which two lugs 22.3 for fixing the body 22.1 to a lower face of one of the two intermediate cross-members 6.4 of the chassis 6 of the table 1 extends horizontally projecting;

two side walls 22*b* of the body, each having an upper edge connected to the upper wall 22*a*, the side walls 22*b* having internal faces forming a non-zero angle $\alpha$, in this case equal to 10 degrees;

a lower wall 22*c* having upper edges connected to lower edges of the side walls 22*b*, the lower wall 22*c* having two internal faces forming a non-zero angle $\beta$, in this case equal to 90 degrees; and a bottom of the body 22*d* connecting the upper wall 22*a*, the side walls 22*b* and the lower wall 22*c* together.

As will be seen below, the angle $\alpha$ is chosen so as to be able to bring the support frame 21 from the returned position or from the deployed position to a first intermediate position or a second intermediate position, called "inclined", either of these intermediate positions being able to be adopted to pass from the returned position to the deployed position, or vice versa.

The side walls 22*b* each comprise a window 22.4 facing one another, and of identical dimensions. The windows 22.4 notch the side walls 22*b* over substantially an upper half of their height along the vertical direction Z. Inside each of the two windows 22.4, a tab 22.5 formed integrally with the corresponding side wall 22*b* extends. Each window 22.4 has, in this case, a rectangular shape delimited by two side flanks extending in the direction of the height of the window along the vertical direction Z of the body 22.1, and an upper flank and a lower flank extending in the direction of the width of the window along a direction orthogonal to the vertical direction Z of the body 22.1. The tab 22.5 extends vertically projecting from the lower flank to the upper flank, and comprises an internal face provided with a rounded raised element 22.6 rotated towards the inside of the groove 22.2 of the body 22.1.

The tabs 22.5 are elastically deformable between a rest state (illustrated in FIG. 5), called retained, in which the raised elements 22.6 define a lower passage cross-section at the diameter of the end sections 21*c* of the first wires 22.1 of the support frame 21, and a deformed state (not represented), called release, in which the raised elements 22.6 define a passage cross-section equal to or slightly greater than the diameter of said end sections 21*c* of the first wires 22.1.

It is understood that when the tabs 22.5 are in the deformed state, the end section 21*c* of the support frame 21 received in the groove 22.2 of the body 22.1 can move along the vertical direction Z between a high position and a low position (illustrated as a dotted line in FIG. 5), in which the end section 21*c* is respectively in contact with the upper wall 22*a* and the lower wall 22*c* of the body 22.1.

It will be noted that the angle β makes it possible, by being non-zero, to ensure a centring of the end section 21*c* in the low position in the groove 22.2 of the body 22.1.

It is also understood that when the tabs 22.5 are in the rest state and when the end portion 21*c* of the support frame 21 is in the high position, said tabs 22.5 prevent said end portion 21*c* from reaching the low position.

The support frame 21 is called in the returned position, when all of the end sections 21*c* of the support frame 21 are in the high position in their respective stop 22.

The support frame 21 is called in the deployed position, when all of the end sections 21*c* of the support frame 21 are in the low position in their respective stop 22. The support frame 21 is called in the inclined position, when the end sections 21*c* of one of the first wires 21.1 of the support frame 21 are in the low position and the end sections 21*c* of the other of the first wires 21.1 are in the high position.

It is thus understood that the tabs 22.5 of the stops 22 form means for retaining the support frame 21 in the returned position, and that the lower walls 22*c* of the stops 22 form means for supporting the support frame 21 in the deployed position. The tabs 22.5 of the stops 22 are arranged to support the weight of the support frame 21 and keep said support frame 21 in the returned position.

The operation and the use of the storage device 20 will now be detailed in reference to FIGS. 3, 6A-6D.

Figure 6A:
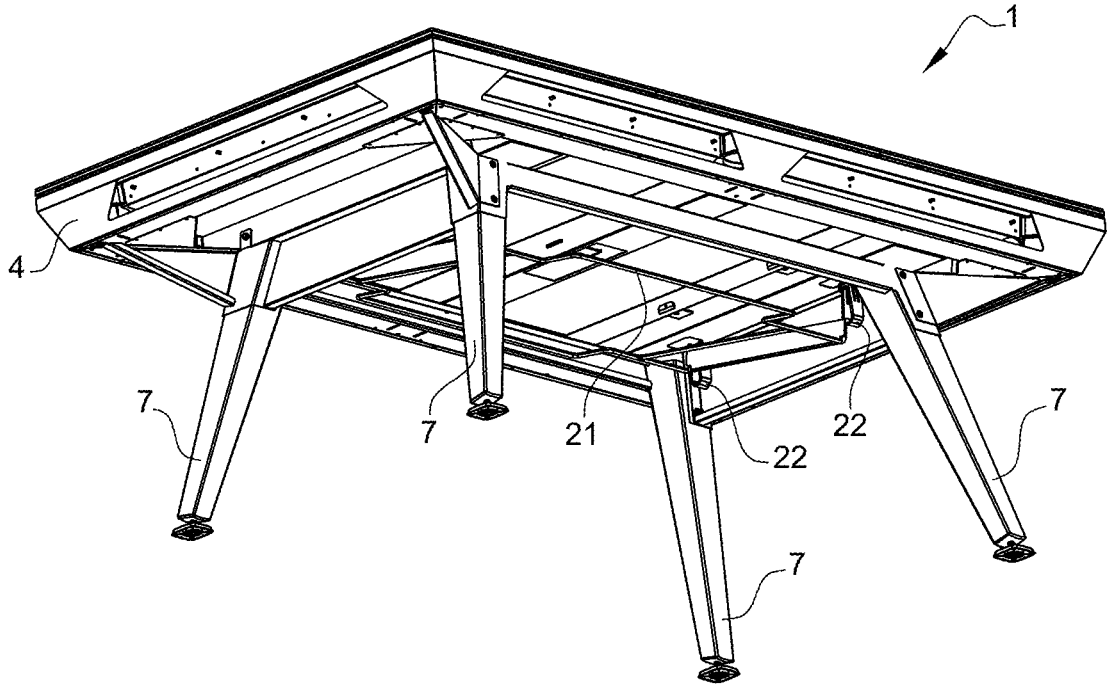
FIG. 6A is a view similar to FIG. 3, in which the basket of the storage device is in an inclined position.

While all of the plates 10.1, 10.2, 10.3 forming the dinner tray 10 is in place on the pool table 1 (FIG. 3), a sufficient transverse force is exerted on the main section 21*a* of one of the first wires 21.1 of the support frame 21 to bring the support frame 21 from the returned position (in which all of the end sections 21*c* are in the high position) to one of the inclined positions (in which two of the end sections 21*c* are in the high position and the two others in the low position) by generating a deformation of the tabs 22.5 in question which thus pass from the rest state to the deformed state before returning to the rest state (FIG. 6A).

It is understood that the passage of the support frame 21 from the returned position to the inclined position corresponds to a rotation of said support frame 21 about the axis defined by the two end sections 21*c* remaining in the high position, in other words to a pivoting of the support frame 21 from its returned position.

Figure 6B:
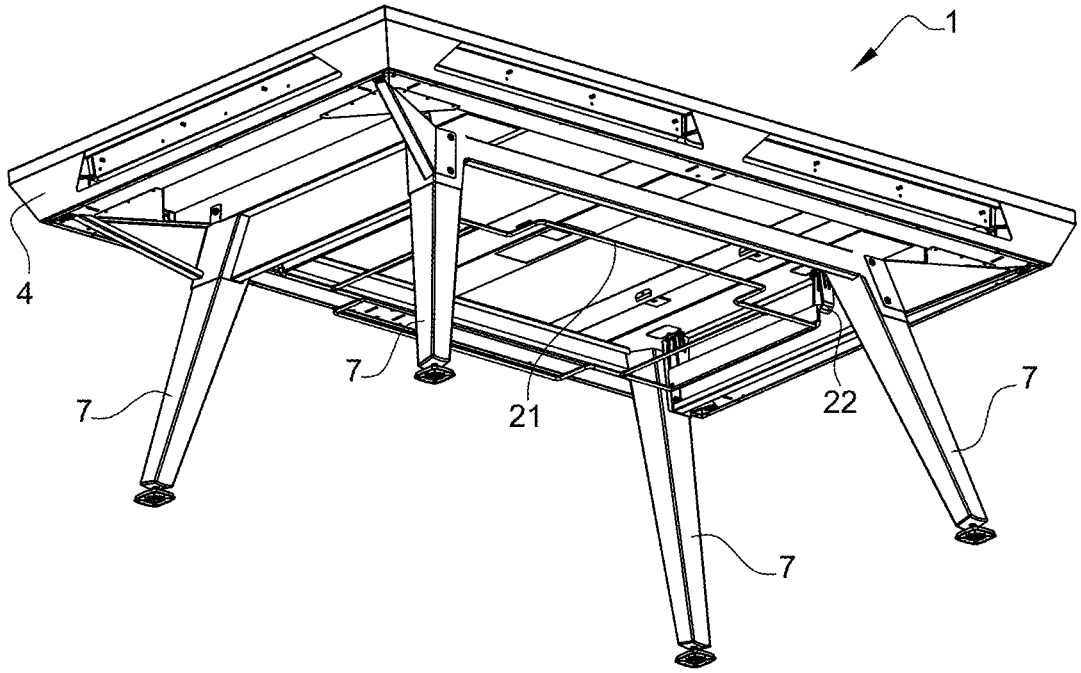
FIG. 6B is a view similar to FIG. 6A, in which the basket of the storage device is in the deployed position.

In the same way, a sufficient transverse force is then exerted on the main section 21*a* of the other of the first wires 21.1 of the support frame 21 to bring the support frame 21 from the inclined position to the deployed position, in which all of the end sections 21*c* are in the low position, by generating a deformation of the tabs 22.5 in question which thus pass from the rest state to the deformed state before returning to the rest state (FIG. 6B).

It is understood that the passage of the support frame 21 from the returned position to the deployed position corresponds to a rotation of said support frame 21 about the axis defined by the two end sections 21*c* remaining in the low position, in other words to a pivoting of the support frame 21 from its inclined position.

It is also understood that one single person disposed on a side of the pool table 1 makes it possible to bring the support frame 21 from the returned position to the deployed position.

One of the plates 10.1, 10.2, 10.3 forming the dinner tray is then disposed on the support frame 21 by rotating said plate 10.1, 10.2, 10.3 by 90 degrees and by making it slide over said support frame 21 in the direction of the width of the pool table 1, between the guiding plates 23 of the support frame 21, until the plate 10.1, 10.2, 10.3 is substantially centred on the support frame 21.

Figure 6C:
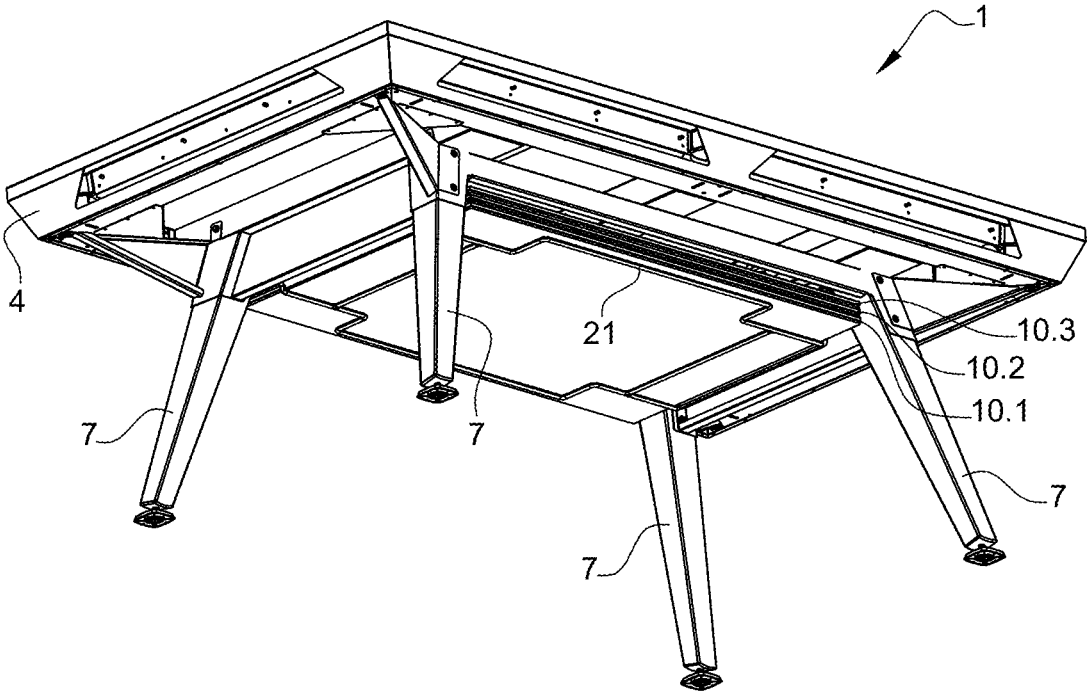
FIG. 6C is a view similar to FIG. 6B, in which the dinner tray is carried by the support frame of the storage device.
Figure 6D:
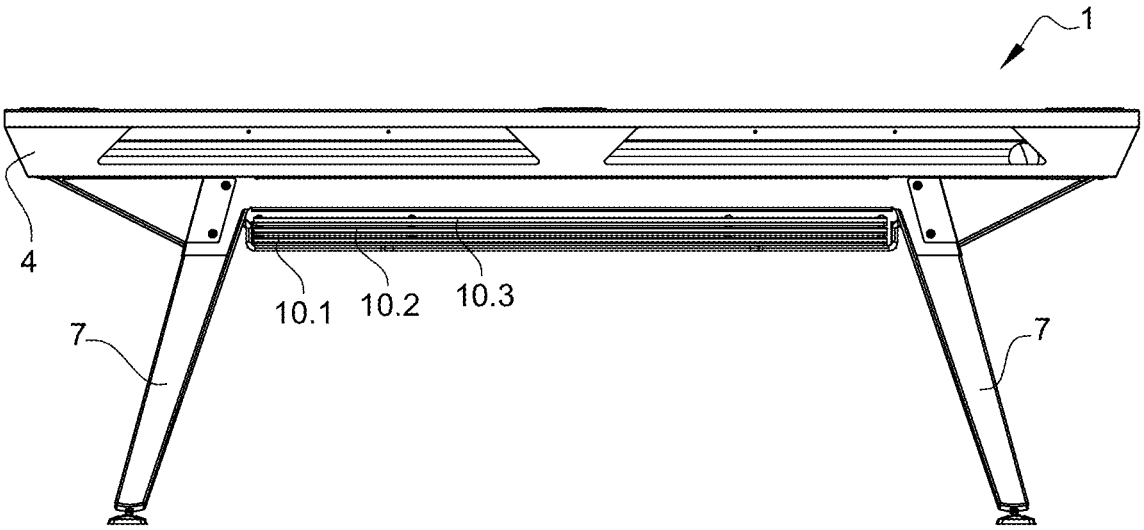
FIG. 6D is a side view of the pool table illustrated in FIG. 6C.

The two other plates 10.1, 10.2, 10.3 are then stacked one after the other on the plate already disposed on the support frame 21 (FIG. 6C-6D).

It is thus understood that all of the plates 10.1, 10.2, 10.3 are stored under the pool table 1 by being carried by the support frame 21.

It will be noted that they are stored on the support frame 21 of the storage device 20, the tray plates 10.1, 10.2, 10.3 are:

relatively visible by the player when the latter is positioned on a longitudinal side of the table (FIG. 6D), and relatively invisible by the player when the latter is positioned on a transverse side of the table (FIG. 6D), the transverse cross-members masking said plates (10.1, 10.2, 10.3).

It will also be noted that when it is in the returned position, the support frame 21 is relatively invisible by the player. The support frame 21 must therefore be returned when it is not used for storing plates 10.1, 10.2, 10.3, although this is not necessary to play pool.

It will further be noted that it is possible to bring the support frame 21 from the returned position to the deployed position, without passing through one of the inclined positions, by simultaneously exerting a transverse force on the first two wires 21.1 of the support frame 21, which requires the presence of two people, each disposed on a side of the pool table 1.

Naturally, the invention is not limited to the embodiment described, but covers any variant coming within the scope of the invention such as defined by the claims.

The tabs 22.5 can be replaced by any other retaining means, capable of keeping the support frame 21 in the returned position: removable pins, supports, etc.

Although, in this case, the support frame 21 has a wired framework, it can be of any other nature: solid, perforated, basket-form, etc.

The support frame 21 can have a form different from that illustrated from the time that it is capable of carrying the plates 10.1, 10.2, 10.3.

Although the end sections 21*c* extend, in this case, along the longitudinal direction X of the table 1, they can also extend along the transverse direction Y of the table. The stops 22 must thus be rotated by 90 degrees. The inclination of the support frame 21 will thus be done along an axis of rotation extending along the transverse direction Y of the table 1.

The plates 10.1, 10.2, 10.3 are not necessarily identical, in particular in terms of dimensions.

The number of plates 10.1, 10.2, 10.3 forming the dinner tray 10 can be less than or greater than three.

The storage device is optional in the direction where it can be added to a pool table 1 which already exists.

Although the invention is, in this case, described in application to a pool table 1, the storage device 20 can be adapted to any games table (table football, etc.).

The invention claimed is:

1. A storage device for storing plates forming a dinner tray for a pool table, comprising a support frame arranged to carry the dinner tray plates, and stops for fixing the support frame to a chassis of the pool table, the stops being arranged to enable a vertical movement of the support frame between a returned position, in which the support frame is intended to extend horizontally to the proximity of the chassis, and a deployed position, in which the support frame is intended to extend horizontally at a distance from the chassis, the stops being provided with means for supporting the support frame in the deployed position and, above the support means, means for retaining the support frame in the returned position, wherein the support frame comprises a wired framework comprising two first wires connected to one another by second wires, the first wires comprising end sections forming tenons intended to be received in a groove provided in the stops.

2. The storage device according to claim 1, wherein the end sections of the first wires extending along one same direction.

3. The storage device according to claim 2, wherein the end sections of each of the first wires extending along one same axis.

4. The storage device according to claim 1, wherein each of the stops comprises a body comprising side walls delimiting the groove, the side walls each comprising a window inside which a tab extends, which is formed integrally with the side wall and which is provided with a raised element rotated towards the inside of the groove to form the retaining means, the tabs being elastically deformable between a rest state in which the raised elements define a passage cross-section less than a diameter of the end sections of the first wires of the support frame, and a deformed state in which the raised elements define a passage cross-section equal to or slightly greater than the diameter of said end sections.

5. The storage device according to claim 4, wherein the raised elements of the tabs are rounded.

6. A Pool table comprising a chassis, under which a storage device is fixed, according to claim 1 via the stops.

* * * * *